US006564695B2

(12) United States Patent
Herder et al.

(10) Patent No.: US 6,564,695 B2
(45) Date of Patent: May 20, 2003

(54) VARIABILITY CONTROL OF VARIABLE DISPLACEMENT COMPRESSORS

(75) Inventors: David H. Herder, Plymouth, MI (US); Mirza-Qadir Mahmood Baig, Inkster, MI (US); Joseph Allen Hackenberg, Three Rivers, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 22 days.

(21) Appl. No.: 09/873,703

(22) Filed: Jun. 4, 2001

(65) Prior Publication Data

US 2002/0178906 A1 Dec. 5, 2002

(51) Int. Cl.[7] ..... F01B 3/00
(52) U.S. Cl. ..... 92/12.2; 92/71
(58) Field of Search ..... 92/12.2, 71; 417/222.1, 417/222.2

(56) References Cited

U.S. PATENT DOCUMENTS

| | | | | | |
|---|---|---|---|---|---|
| 4,475,871 | A | | 10/1984 | Roberts | |
| 4,543,043 | A | | 9/1985 | Roberts | |
| 4,729,718 | A | | 3/1988 | Ohta et al. | |
| 4,880,360 | A | | 11/1989 | Terauchi et al. | |
| 4,960,366 | A | | 10/1990 | Higuchi | |
| 5,056,416 | A | | 10/1991 | Ota et al. | |
| 5,255,569 | A | | 10/1993 | Terauchi et al. | |
| 5,782,160 | A | * | 7/1998 | Boone | 92/12.2 |
| 5,894,782 | A | | 4/1999 | Nissen et al. | |
| 5,980,216 | A | * | 11/1999 | Tokumasu | 92/12.2 |
| 6,139,283 | A | | 10/2000 | Ahn | |
| 6,415,615 | B1 | * | 7/2002 | Osborne et al. | 62/130 |

* cited by examiner

*Primary Examiner*—Edward K. Look
*Assistant Examiner*—Michael Leslie
(74) *Attorney, Agent, or Firm*—Brinks Hofer Gilson & Lione

(57) ABSTRACT

Improvements for variable capacity compressors are provided utilizing a multitude of springs in varying arrangements between the plate and rotor within the compressors. The advantages may include increased spring constant, increased variability control, and increased packaging efficiency. Methods of constructing variable capacity compressors utilizing a multitude of springs in varying arrangements between the plate and rotor are also provided.

16 Claims, 4 Drawing Sheets

VARIABILITY CONTROL OF VARIABLE DISPLACEMENT COMPRESSORS

BACKGROUND

This invention relates generally to the utilization of a spring in variable capacity compressors.

Conventional variable capacity compressors utilize two devices, a control valve and a single coil spring to control the capacity of the compressor. When pressures are high, a stiffer spring rate is required. To achieve the higher spring rate, a single coil spring is typically made larger, which in turn increases the size of the required compressor.

The use of a single spring to help control the capacity of compressors has several disadvantages including low spring constant, less variability control, and low packaging efficiency.

SUMMARY

It is in general an object of the invention to utilize a multitude of springs in variable capacity compressors.

In one aspect, an improved variable capacity swash plate type compressor includes a rotor, a drive shaft, and a swash plate disposed on the drive shaft movable to various inclination angles relative to the drive shaft. The improvement comprises a plurality of springs disposed between the rotor and the swash plate.

In another aspect, an improved variable capacity compressor includes a rotor, a drive shaft, and a plate disposed on the drive shaft movable to various inclination angles relative to the drive shaft. The improvement comprises a plurality of springs, disposed between the rotor and the plate, arranged coaxially.

In an additional aspect, a method of constructing a variable capacity swash plate type compressor is provided. A rotor, a drive shaft, a swash plate disposed on the drive shaft movable to various inclination angles relative to the drive shaft, and a plurality of springs are provided. The plurality of springs is disposed between the rotor and the swash plate. The plurality of springs is secured between the rotor and the swash plate.

In another aspect, a method of constructing a variable capacity compressor is detailed. A rotor, a drive shaft, a plate disposed on the drive shaft movable to various inclination angles relative to the drive shaft, and a plurality of springs is provided. The plurality of springs is disposed between the rotor and the plate coaxially. The plurality of springs is secured coaxially between the rotor and the plate.

Using a plurality of springs may increase the spring constant, increase variability control, and increase packaging efficiency.

The present invention, together with further objects and advantages, will be best understood by reference to the following detailed description taken in conjunction with the accompanying drawings.

DETAILED DESCRIPTION OF THE PREFERRED EMBODIMENTS

A description of the inner workings of a variable capacity swash plate type compressor is provided in U.S. Pat. No. 6,139,283 to Ahn, entitled "variable capacity swash plate type compressor", the disclosure of which is incorporated herein by reference. Using a plurality of springs is not limited to swash plate type compressors, and is applicable to other types of plate compressors including slant plate compressors and other types of plate compressors.

Figure 1:
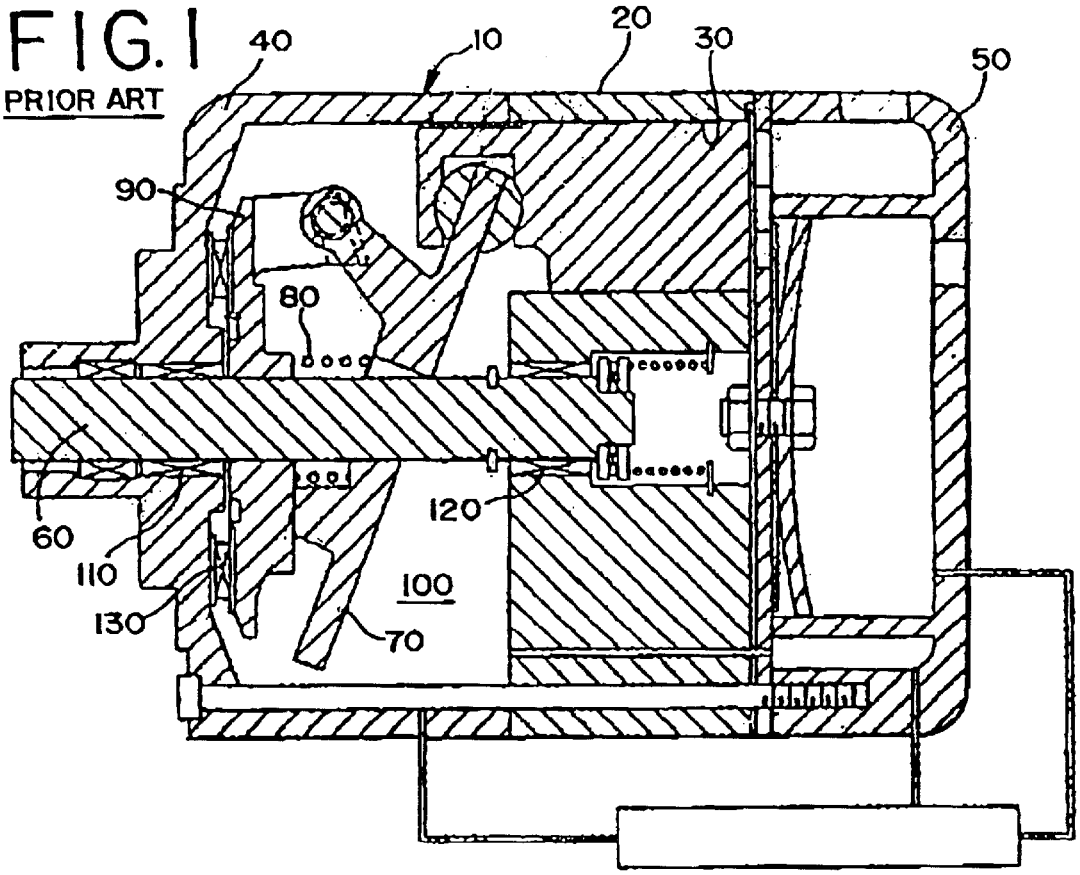
FIG. 1 PRIOR ART
FIG. 1 is a longitudinal cross-sectional view of one embodiment of a variable capacity swash plate type compressor.

FIG. 1 shows a longitudinal cross-sectional view of a variable capacity swash plate type compressor 10 utilizing a single spring 80. The variable capacity swash plate type compressor 10 includes a cylinder block 20 provided with a plurality of cylinder bores 30, a front housing 40, a rear housing 50, a drive shaft 60, a swash plate 70, a single spring 80, and a rotor 90. Both front and rear ends of the cylinder block 20 are sealed closed by the front housing 40 and rear housing 50. The cylinder block 20 and the front housing 40 define an air-tight crank chamber 100. The drive shaft 60 is centrally arranged to extend through the front housing 40 to the cylinder block 20 and rotatably supported by radial bearings 110 and 120.

The rotor 90 is fixedly mounted on the drive shaft 60 within the crank chamber 100 and supported by a thrust bearing 130 seated on an inner end of the front housing 40. The swash plate 70 is supported on the drive shaft 60. A spherical sleeve, or hub, can be mounted between the drive shaft 60 and the swash plate 70. In this embodiment, the swash plate 70 is rotatably supported on an outer surface of the hub. The swash plate 70 and the rotor 90 both rotate with the drive shaft 60. During rotation, the swash plate 70 moves to various inclination angles relative to the drive shaft 60 in response to changing pressure within the crank chamber 100. The spring 80 is disposed between the rotor 90 and the swash plate 70 coaxially around the drive shaft 60 to apply force towards the swash plate 70 when compressed.

Figure 2:
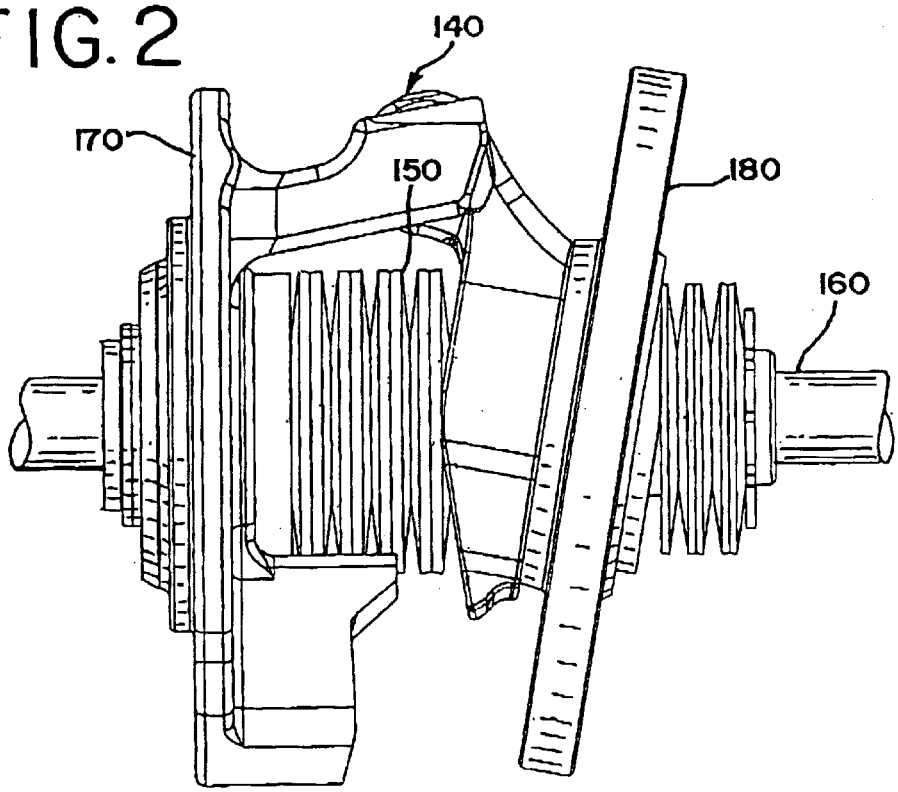
FIG. 2 is a partial longitudinal view of one embodiment of a belleville washer coaxial stacked arrangement in a variable capacity swash plate type compressor.

FIG. 2 shows a portion 140 of a variable capacity compressor utilizing a plurality of springs, as opposed to a single spring, in a variable capacity compressor. The portion 140 includes a stacked arrangement of belleville washers 150, also referred to as "disc springs", arranged coaxially around a drive shaft 160. In this embodiment, belleville washers are utilized, but other types of springs may also be used. The coaxial arrangement may consist of springs having the same diameter aligned with each other, and may consist of springs having various diameters in varying alignments. The coaxial arrangement does not have to be arranged around a drive shaft and may be arranged in altering arrangements outside of the drive shaft. The belleville washers 150 are disposed between a rotor 170 and a plate 180. The term "plate" includes swash plates, slant plates, wobble plates, and other types of plate systems used in compressors. The plate 180 is disposed on the drive shaft 160 and is movable to various inclination angles relative to the drive shaft 160. As the drive shaft 160 rotates, the rotor 170 and plate 180 also rotate. The belleville washers 150 apply force towards the plate 180 when compressed.

The belleville washers 150 may be organized in the same orientation relative to each other (i.e., in a parallel arrangement), in opposite orientations relative to each other (i.e., in a series arrangement), or in varying orientations relative to each other (i.e., a combination parallel and series arrangement). The orientation of the arrangement determines the amount of force applied when compressed. Stacking in a parallel arrangement yields higher spring constants. Stacking in a series arrangement yields lower spring constants. Stacking in a parallel and series arrangement provides even greater flexibility in the range of spring constants. The diameters, thickness, and height of the belleville washers 150 may also be varied to achieve a wide variety of spring constants. Alternatively, the belleville washers 150 comprise the same sized springs. The stacked arrangement of belleville washers 150 allows for a variety of spring constant, improved variability control, and packaging efficiency.

Figure 3:
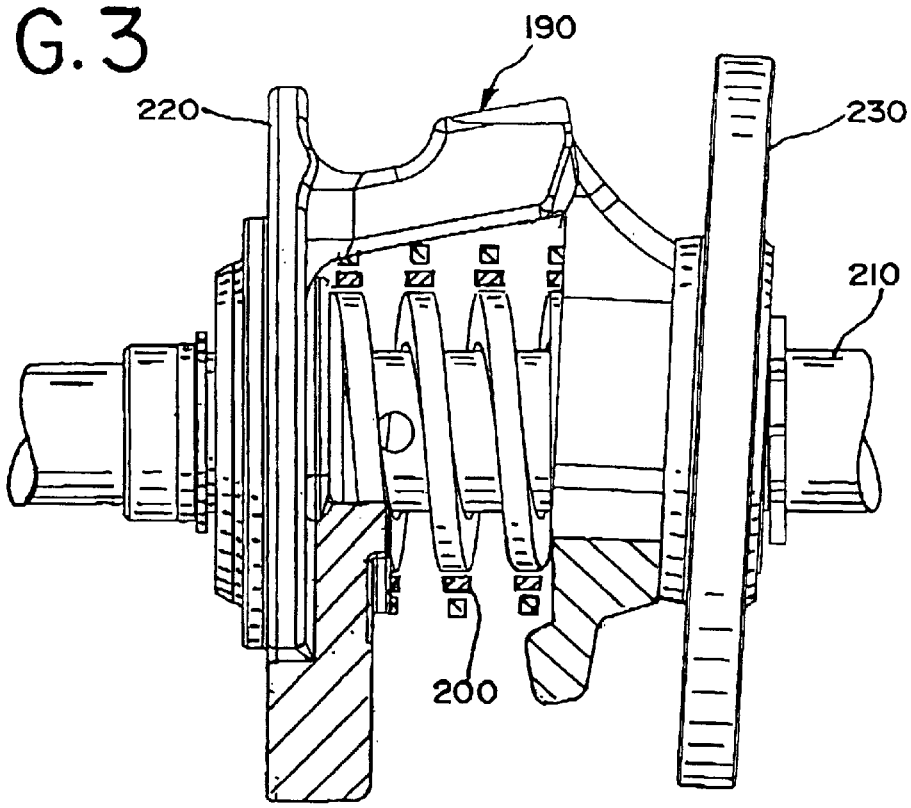
FIG. 3 is a partial longitudinal view of one embodiment of a nested spring arrangement in a variable capacity swash plate type compressor.

FIG. 3 shows another portion 190 of a variable capacity compressor utilizing a plurality of springs, as opposed to a single spring. This portion 190 includes a nested arrangement of coil springs 200 arranged coaxially around a drive shaft 210. The nested arrangement may include springs of varying diameters wherein each nested spring is nested within another spring having a larger diameter. The nested arrangement may also be varied to include springs of equal or varying diameters wherein only some springs are nested within another spring having a larger diameter. The nested arrangement does not have to be arranged around a drive shaft and may be arranged in altering arrangements outside of the drive shaft. In this embodiment, coil springs are utilized, but other types of springs may also be used. The coil springs 200 are disposed between a rotor 220 and a plate 230. The plate 230 is disposed on the drive shaft 210 and is movable to various inclination angles relative to the drive shaft 210. As the drive shaft 210 rotates, the rotor 220 and plate 230 also rotate. The nested arrangement of coil springs 200 applies force towards the plate 230 when compressed. The nested arrangement of coil springs 200 may allow for an increased spring constant, improved variability control, and packaging efficiency.

Figure 4:
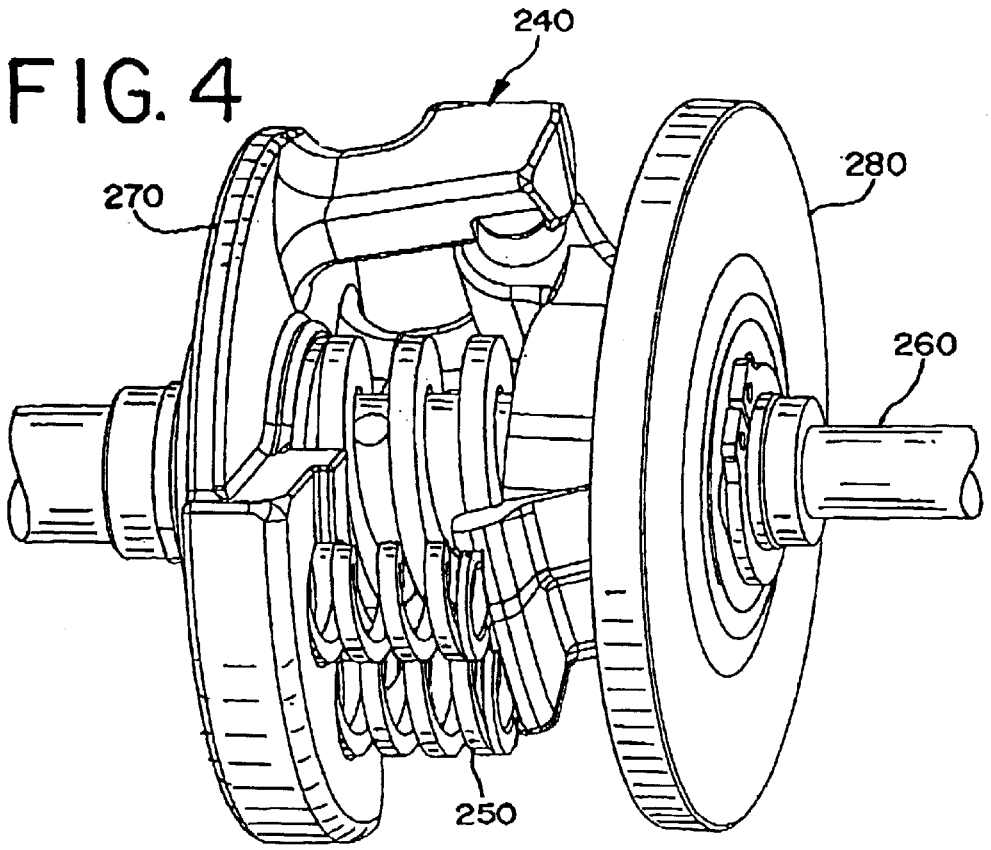
FIG. 4 is a partial longitudinal view of one embodiment of a spring arrangement, wherein the springs are arranged at a distance from the shaft, in a variable capacity swash plate type compressor.

Disclosed in FIG. 4 shows yet another portion 240 of a variable capacity compressor utilizing a plurality of springs, as opposed to a single spring. This portion 240 includes a plurality of coil springs 250 arranged around a drive shaft 260, at a distance from the drive shaft 260. The distance the coil springs 250 are arranged around the drive shaft 260, may be equal distances or varying distances. In this embodiment, coil springs are utilized, but other types of springs may also be used. The coil springs 250 are disposed between a rotor 270 and a swash plate 280. The swash plate 280 is disposed on the drive shaft 260 and is movable to various inclination angles relative to the drive shaft 260. As the drive shaft 260 rotates, the rotor 270 and swash plate 280 also rotate. The coil springs 250 apply force towards the swash plate 280 when compressed. The arrangement of coil springs 250 at a distance from the shaft 260 may allow for an increased spring constant, improved variability control, and packaging efficiency.

Figure 5:
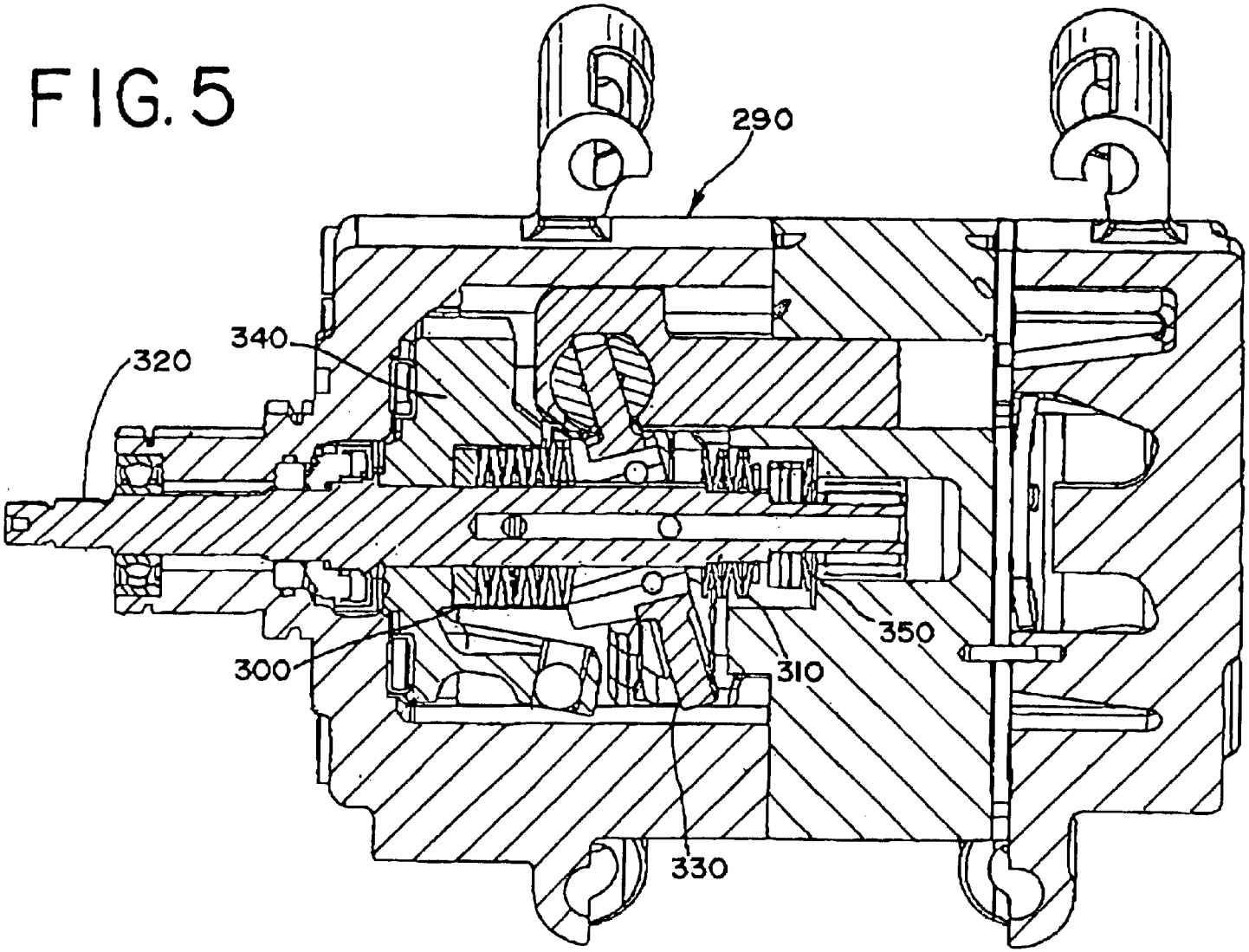
FIG. 5 is a longitudinal cross-sectional view of one embodiment of a variable capacity swash plate type compressor utilizing two sets of a plurality of springs.

FIG. 5 shows another portion 290 of a variable capacity compressor utilizing a plurality of springs, as opposed to a single spring. This portion 290 includes the use of two sets of belleville washers 300 and 310, arranged in stacked arrangement coaxially to the drive shaft 320, both above 300 and below 310 the plate 330. Although two sets of belleville washers 300, 310 are used in this embodiment, any number of sets may be used. In this embodiment, belleville washers are utilized, but other types of springs may also be used. The set of belleville washers 300 above the plate 330 is disposed between the plate 330 and the rotor 340. The set of belleville washers 310 below the plate 330 is disposed between the plate 330 and the lower housing 350. The plate 330 is disposed on the drive shaft 320 and is movable to various inclination angles relative to the drive shaft 320. As the drive shaft 320 rotates, the rotor 340 and plate 330 also rotate. The sets of belleville washers 300 and 310 apply force towards the plate 330 when compressed.

Figure 6:
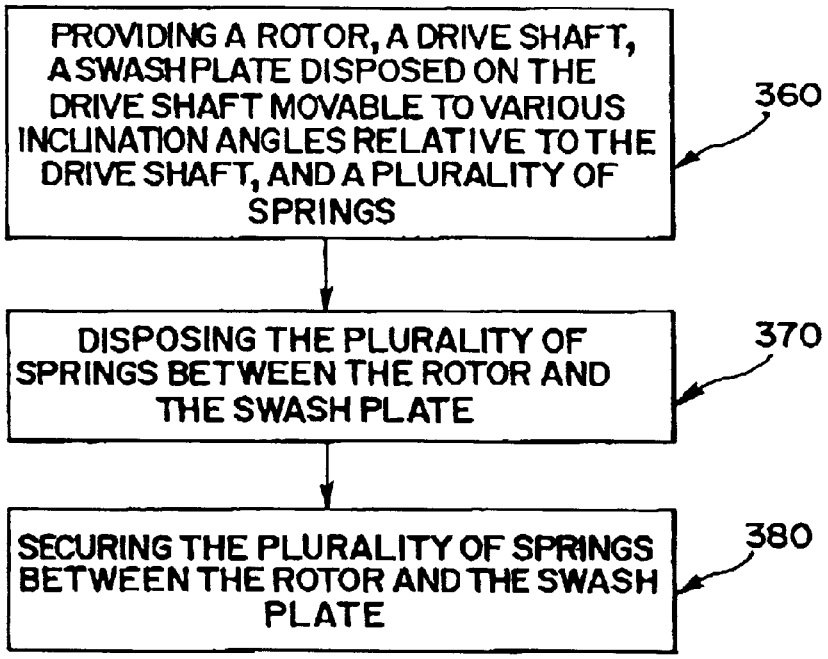
FIG. 6 is a flow chart showing one embodiment of a method of constructing a variable capacity swash plate compressor.

FIG. 6 shows a method of constructing a variable capacity swash plate type compressor. A rotor, a drive shaft, a swash plate disposed on the drive shaft movable to various inclination angles relative to the drive shaft, and a plurality of springs are provided in act 360. The plurality of springs is disposed between the rotor and the swash plate in act 370. In act 380, the plurality of springs is secured between the rotor and the swash plate. The springs, which may be a variety of different springs including coil springs or belleville washers, may be disposed to apply force towards the swash plate when compressed. The springs may be secured in a coaxially stacked arrangement around the shaft, arranged in the same or varying orientation relative to each other, arranged coaxially around the drive shaft in nested arrangement, arranged at varying or equal distances from the drive shaft, or arranged alternatively. Additionally, the springs may be secured by using springs dimensioned to be fitted onto a component of the compressor, or by other methods of attachment.

Figure 7:
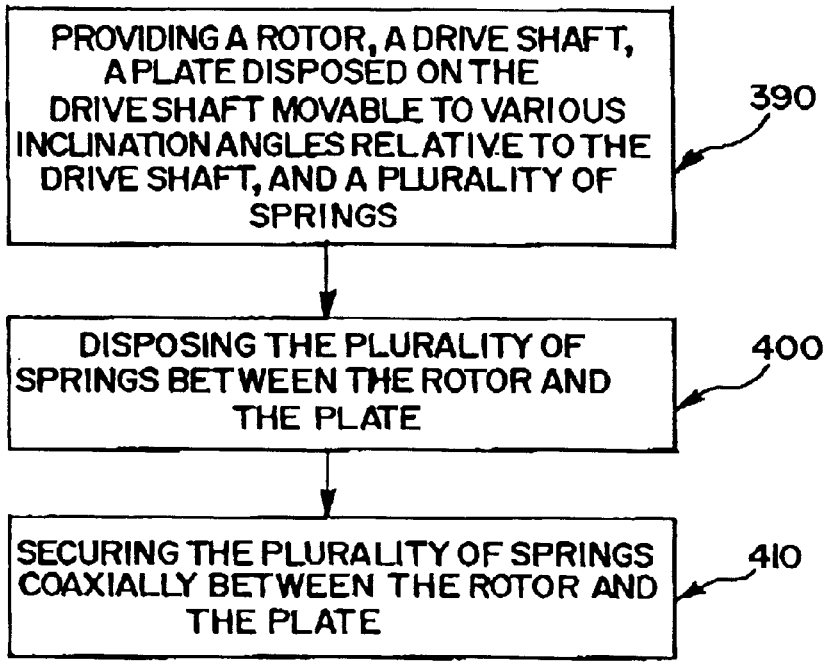
FIG. 7 is a flow chart showing one embodiment of a method of constructing a variable capacity compressor.

FIG. 7 shows another method of constructing a variable capacity compressor. A rotor, a drive shaft, a plate disposed on the drive shaft movable to various inclination angles relative to the drive shaft, and a plurality of springs are provided in act 390. The plurality of springs is disposed between the rotor and the plate in act 400. In act 410, the springs are secured coaxially between the rotor and the plate. The plurality of springs may be secured coaxially around the shaft in stacked arrangement. The plurality of springs may also be secured coaxially around the shaft in nested arrangement, or in alternative arrangements. The springs, which may be a variety of different springs including coil springs or belleville washers, may be disposed to apply force towards the swash plate when compressed. The springs may be secured in the same or varying orientation relative to each other. Again, the springs may be secured by using springs dimensioned to be fitted onto a component of the compressor, or by other methods of attachment.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that the appended claims, including all equivalents thereof, are intended to define the scope of the invention.

What is claimed is:

1. In a variable capacity swash plate type compressor including a rotor, a drive shaft, and a swash plate disposed on said drive shaft, said swash plate movable to various inclination angles relative to said drive shaft, the improvement comprising:

a plurality of springs disposed between said rotor and said swash plate.

2. The compressor of claim 1 wherein said springs are arranged at a distance from said shaft.

3. The compressor of claim 2 wherein said springs are arranged at equal distances from said shaft.

4. The compressor of claim 1 wherein said springs are coil springs.

5. In a variable capacity compressor including a rotor, a drive shaft, and a plate disposed on said drive shaft, said plate movable to various inclination angles relative to said drive shaft, the improvement comprising:

a plurality of springs disposed between said rotor and said plate, wherein said springs are arranged coaxially.

6. The compressor of claim 5 wherein said springs are belleville washers.

7. The compressor of claim 5 wherein said springs are coil springs.

8. The compressor of claim 5 further comprising a second plurality of springs disposed against a second side of said plate.

9. The compressor of claim 5 wherein said springs are arranged in the same orientation relative to each other.

10. The compressor of claim 5 wherein said springs are arranged in varying orientations relative to each other.

11. The compressor of claim 5 wherein said springs are arranged coaxially around said shaft in stacked arrangement.

12. The compressor of claim 5 wherein said springs are arranged coaxially around said shaft in nested arrangement.

13. A method of constructing a variable capacity swash plate type compressor comprising:

providing a rotor, a drive shaft, a swash plate disposed on said drive shaft, said swash plate movable to various inclination angles relative to said drive shaft, and a plurality of springs;

disposing said plurality of springs between said rotor and said swash plate; and securing said plurality of springs between said rotor and said swash plate.

14. A method of constructing a variable capacity compressor comprising:

providing a rotor, a drive shaft, a plate disposed on said drive shaft, said plate movable to various inclination angles relative to said drive shaft, and a plurality of springs;

disposing said plurality of springs between said rotor and said plate, wherein said springs are arranged coaxially; and securing said plurality of springs coaxially between said rotor and said plate.

15. The invention of claim 14 wherein securing comprises securing the plurality of springs coaxially around said shaft in stacked arrangement.

16. The invention of claim 14 wherein securing comprises securing the plurality of springs coaxially around said shaft in nested arrangement.

* * * * *